United States Patent [19]

Pick

[11] 3,975,745

[45] Aug. 17, 1976

[54] FONT AVAILABILITY SYSTEM FOR PHOTOCOMPOSING MACHINE

[75] Inventor: George G. Pick, Mendham, N.J.

[73] Assignee: Addressograph Multigraph Corporation, Cleveland, Ohio

[22] Filed: Mar. 17, 1975

[21] Appl. No.: 558,720

[52] U.S. Cl. ..... 354/7; 354/13; 354/14

[51] Int. Cl.[2] ..... B41B 17/06

[58] Field of Search ..... 354/12, 13, 14, 15, 354/16, 17, 18, 19, 5, 7

[56] References Cited

UNITED STATES PATENTS

| | | | |
|---|---|---|---|
| 2,989,904 | 6/1961 | Braggs et al. | 354/14 |
| 3,099,945 | 8/1963 | O'Brien | 354/13 |
| 3,602,116 | 8/1971 | Moyroud | 354/10 |
| 3,791,271 | 2/1974 | Nishikawa | 354/13 |

*Primary Examiner*—Joseph W. Hartary
*Attorney, Agent, or Firm*—Ray S. Pyle

[57] ABSTRACT

A photographic compositor having a letter pattern carrying section comprising a plurality of letter pattern carrying discs which are rotatably mounted on a common rotatable shaft at intervals, and an optical system disposed to cooperate with one side of a selected disc wherein a beam for illuminating letter patterns carried in a track on a disc is caused to reside between a pair of adjacent letter pattern carrying discs by interspersing a selected disc with said optical system and then passing the beam through a letter pattern and out through the space between a pair of discs of the following stage, said optical system and said letter pattern carrying section mounted for relative movement in a path perpendicular to the axis of said rotatable shaft, said movement having a first limit which separates the largest disc carried by said shaft from said optical system, and a second limit position preselected to position a track of any selected disc into projection relationship with said system, and means to shift said letter pattern carrying section in the direction of the shaft axis while said section is in said first limit position; whereby, said plurality of discs may be removed from interface with said optical system, shifted to align a substitute disc, and repositioned to select various tracks on selected discs at will.

7 Claims, 7 Drawing Figures

FONT AVAILABILITY SYSTEM FOR PHOTOCOMPOSING MACHINE

BACKGROUND OF THE INVENTION

This invention relates generally to improvements in photographic compositors and it relates particularly to an improved character storage device and optical retrieval and projection system.

Photographic composition is a relatively new art, and the art has concentrated most heavily upon reliability and composition technique. These areas have been well developed and effort is now progressing on speed. News and communication requires ever increasing rapidity of typesetting.

The prior art does contain issued patents which have made an effort to increase speed and/or availability of front face designs by providing a plurality of rotating disc font source devices in one machine. An example of multiple disc source is Moyroud U.S. Pat. No. 3,602,116. In this patent a pair of interchangeable discs are removably mounted for rotation on a common shaft, and a lens turret is used for changing size. There are other patents by this inventor on the multiple projection concept.

A later development by a Japanese inventor, Nishikawa, set forth in U.S. Pat. No. 3,791,271 deals with the problem of languages which have a far greater number of characters than the English and European languages. Nishikawa uses a plurality of axially spaced coaxial discs with parallel flash beams directed parallel to the face of each disc, transmitted through characters, and then deflected parallel to and along the opposite face of the disc for selection of an individual character by manipulation of the output.

This latter development requires a considerable number of continuously operating lenses and reflecting systems with selection being accomplished by selection of a beam out of many beams coming from the group of discs.

Accordingly, the prior art to this time has suggested multiple disc font sources for two distinctively different purposes, but has not produced an ultimate font bank from which a large group of distinct character font faces can be stored and selectively projected for particular composition without the necessity of changing discs on a single or multiple spindle machine.

SUMMARY OF THE INVENTION

This invention has for its principle object an improved access system for making available particular font on a particular font track of one font storage disc in a bank of such disc.

DESCRIPTION OF THE PREFERRED EMBODIMENT

This invention is directed to a photocomposition machine in general, but the specific improvement is in the means for providing an increased quantity of font faces rapidly accessible. Thus, a photo-composition machine, whether it employs a collimated line escapement plan, an optical lever plan, a moving receiving surface carrier or some other plan, may receive photographic impressions from the novel portion of the disclosure herein.

Figure 1:
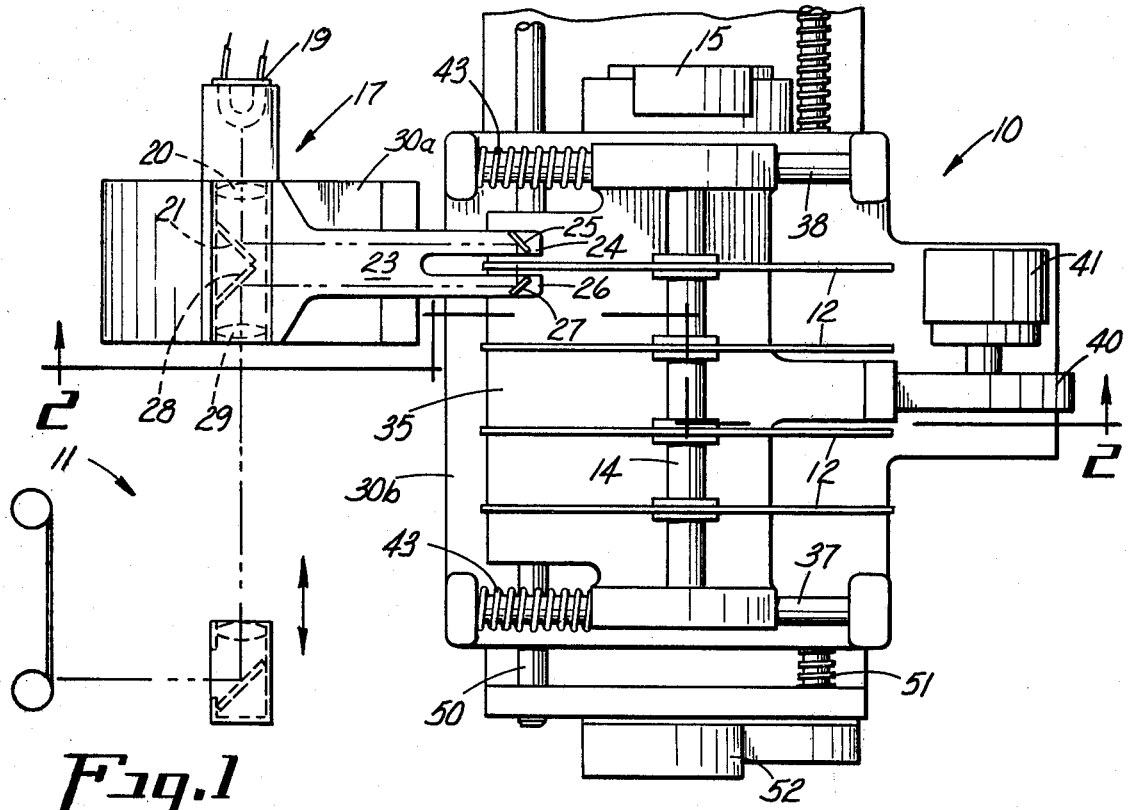
FIG. 1 is a top plan view of a font storage and optical retrieval system for a photocomposition machine.

In the drawing, referring particularly to FIG. 1, a letter pattern carry section 10 is shown providing a photographic font output to aphotocomposer 11.The composer 11 is illustrated as using collimating lenses such as taught in U.S. Pat. No. 2,670,665.

The section 10 carries a plurality of indicia storage disc members 12 which are mounted on a common shaft 14 in superposed relationship substantially at regular intervals. A motor 15 is illustrated as the driving means for rotating the shaft 14 and the disc members about a common axis of the shaft.

Each disc member has at least one data set in a circular track path. Such disc members normally carry several data paths and one example of a suitable disc member is illustrated in U.S. Pat. No. 3,733,977. The markings in FIG. 2 on disc 12 suggest four data font tracks as one example.

An optical system 17, which may also be referred to as a projection system, is mounted on a frame base 30. In the illustration, there is no effort to show a complete machine frame which is necessary for building any unitary device. Hence, the frame is incorporated in the frame base **30*a* for the optical system and 30*b*** supporting the plurality of discs. Together, these may be considered to be a support frame.

In the illustration, the means for accessing the data from a disc and bringing it out to the photocomposer 11 is literally an optical system, but may be thought more generically as a projection system because any means for extracting the shape and form of a character from a transparency and bringing it to the photocomposer is literally a means for projecting, or a projecting system.

The optical system 17 as illustrated is embodied generally around a xeon tube 19 with a lens 20 reflecting light off of a mirror 21.

A bifurcated stanchion 23 has a first arm 24 which carries a mirror 25 to turn the light beam from the lens 20 and mirror 21 in a direction perpendicular to the face of a disc which is moved into position between the arm 24 and a second arm 26 of the bifurcated stanchion 23.

Light passing through a disc 12 positioned between the arms 24 and 26 is picked up by a mirror 27 and turned at a substantially right angle back to the base of the stanchion where a mirror 28 is mounted and projects the light path to a lens 29.

This described bifurcated stanchion with its arms and mirrors may be referred to as an offset side loop of the optical system because of its path configuration which can accept the disc members but provide the light source and focusing devices outside of the area of the disc members.

In modern photocomposer procedures, the escapement action of the photosensitive paper within the composer 11 is related to the width value assigned to a particular character. In the English language, for example, the "m" and "w" letters are much wider than the letter "i". Hence, if each letter is given uniform space, the resulting printed word is unpleasant to view and not harmonious. Hence, the escapement is normally less for the more narrow letters than the wider letters. The amount of escapement is established by the artist who designs the font and differs with different styles of font faces. It is not feasible to establish a given amount of escapement for a particular letter of an alphabet and expect every font style to appear harmonious. Therefore, the practice has been adapted to assign width codes on the disc 12 for each character that is to be projected. That width code is read by an optical system in the same manner as timing marks are read, and the information gleaned is supplied to a computer program which is used as a controller for the photocomposer 11. Also, it is normal that the width code track for a particular disc 12 will be the same for the group of fonts on that particular disc. Therefore, the system which gleans the width code information is normally focused upon the same area of the disc regardless of which one of the multiple fonts of that disc is selected.

In the illustrated embodiment of the invention, this multiple selection of fonts and unitary selection of width code is solved by means of a unique system which causes the width code head to follow the movement of the carriage when the disc is indexed, but allows the projection system for the fonts to remain stationary and hence relatively movable.

Figure 2:
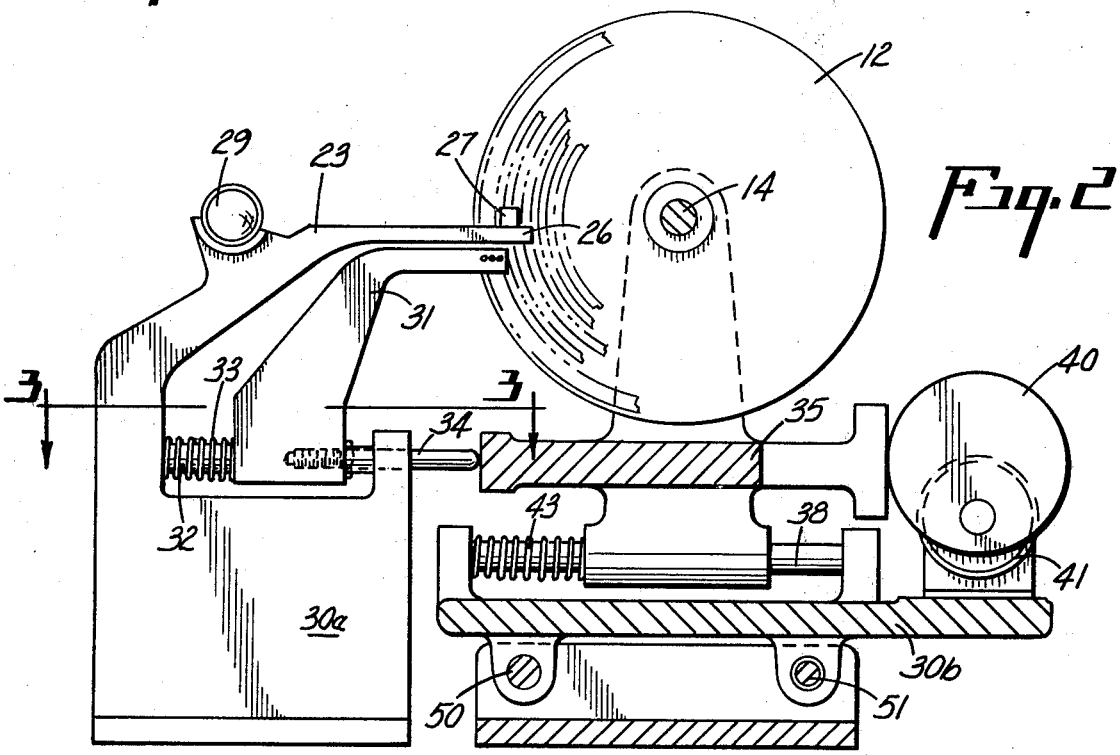
FIG. 2 is a section view taken along line 2—2 of FIG. 1.
Figure 3:
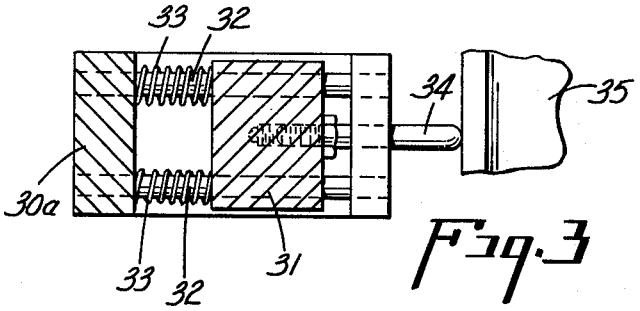
FIG. 3 is a section view taken along 3—3 of FIG. 2, of an optical system mounting portion of the system.
Figure 4:
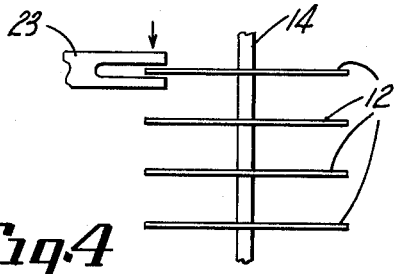
FIGS. 4 – 7 are schematic selection step movements of the system.
Figure 5:
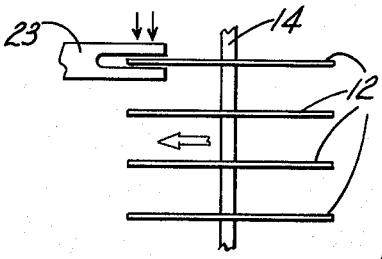
Figure 7:
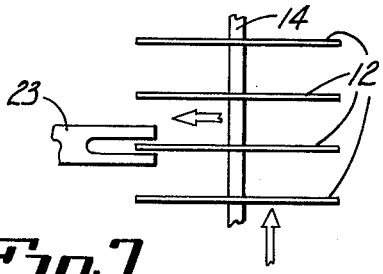
Figure 6:
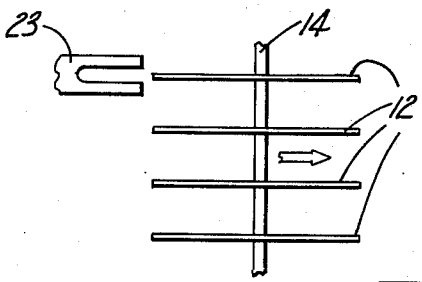

This may be explained by observing the FIGS. 2 and 3 in particular. A stanchion 31 may be referred to as a fixed track reader because it is intended to read the same width code track regardless of the indexed position of the frame and the plurality of discs 12. The stanchion 31 is mounted upon ways 32 as shown in FIG. 3, and urged by means of springs 33 toward a support carriage 35 which carries the discs. A cam rod 34 is carried by the stanchion 31 and is guided in base 30*a* toward a bumper section of a support carriage 35. Therefore, the movement of the stanchion 31 is precisely the same as the movement laterally of the carriage 35. The result is that the reading devices carried by the end of the stanchion 31, in essentially the same manner as that described with respect to the stanchion 23, although a continuous light source and photocells are preferably employed rather than the optical focusing system.

The support carriage 35 is mounted in such a way that it provides a means for moving the disc 12 and the projection system 17 relative to one another in a series of defined paths which select a data set track path and project the data thereon, said series of paths comprising lateral relative movements which shift the disc and system relative to one another such that the mirrors 25 and 27 embrace one of the selected font paths. Such lateral movement is provided by mounting carriage 35 on way rods 37 and 38 in order to cause the shaft 14 to move in a path which is perpendicular to its longitudinal axis, in a manner suggested by the arrows in the FIGS. 4 through 7.

A cam 40 driven by a stepper motor 41 is employed to drive the carriage 35 toward the base 30*a*, and springs 43 urge the carriage 35 in the opposite direction. Hence, by moving the cam 40 through a definite number of driven steps by the stepper motor 41, the exact alignment of the mirrors 25 and 27 with a selected font can be predetermined. Normally such predetermined location is selected by a program within a controller associated with the photocomposer 11, although a hand controlled device may be provided for stepping the motor a given amount under operator control. Such computer controlled devices under program are old and wellknown and need not be delineated in detail herein.

The described mechanism will enable the carriage 35 to move laterally for selecting a particular font, and as previously described, the width code reading device will follow a single track of the disc, and therefore any one of a plurality of font tracks on a given singular disc may be selected with the apparatus as thus far described.

However, in order to select a data path in another disc 12, the shaft 14 must be shifted along its own axis. Longitudinal shifting is provided by mounting the base 30*b* on a way rod 50 and a drive screw 51 driven by motor 52.

The procedure for selecting is then modified in that the cam 40 is first rotated to a position which causes the perpendicular movement of the shaft 14 to a first limit which separates the largest disc carried by the shaft from the interfitting relationship with the optical system. In the drawings all of the discs 12 are shown of one uniform size, but variable size discs are acceptable if such is desired. A second limit position is one which is preselected to position one of the data tracks of a selected disc into projection relationship with the system 17. First, however, having permitted separation, then the particular disc 12 to be selected is moved by driving the screw 51 by means of motor 52 until the selected disc is aligned with the space between the arms of the bifurcated stanchion 23. Then, the cam 40 is caused to rotate until the proper second position limit is reached which is defined as that nominated location which registers a particular track with the optical system.

Accordingly, the object of the invention is carried out by this particular illustrated embodiment wherein a plurality of storage disc members are rotated in unison, but are separable from the projection system in order to shift the projection system and disc relative to one another, preferably by moving the disc and keeping the projection system fixed, and then after selecting and aligning a disc desired with the projection system, the carriage 35 of the machine moves perpendicular to the axis of the rotating shaft to engage a new disc and a selected new font track for projection.

This system is rapid enough to be well within acceptable speed limits of the technology currently available.

What is claimed is:

1. A font storage and optical retrieval system for a photocomposition machine, comprising:

a plurality of indicia storage disc members mounted in superposed relationship, and means for rotating said disc members about a common axis, each said disc having at least one data set in a circular track path;

a projection system;

and, means for moving said discs and projection system relative to one another in a series of defined paths which select a data set track path and project the data thereon, said series of paths comprising longitudinal and lateral relative movements which first disengage the discs and system and thereafter shift the discs and system relative to one another and finally reengage a disc and the projection system to project another selected data set;

whereby, said plurality of discs may be removed from interface with said system, shifted to align a substitute disc, and repositioned to select various data sets at will.

2. A font storage and optical retrieval system for a photocomposition machine, comprising:

a support frame;

a plurality of indicia storage disc members mounted in superposed relationship, and means for rotating said disc members about a common axis, each said disc having at least one data set in a circular track path;

a projection system mounted on said support frame, said projection system having a fixed residence in space;

means mounting said indicia storage discs for movement of axis parallel to said axis into a first station position a distance from said projection system greater than the diameter of the largest disc and into selected ones of a plurality of relative positions with respect to said projection system wherein said projection system is adjacent a selected data set track path; and means for shifting said storage discs along the axis thereof to place a selected one of said discs into alignment with said projection system;

whereby, said plurality of discs may be removed from interface with said head, shifted to align a substitute disc, and repositioned to select various data sets at will.

3. A font storage and optical retrieval system for a photocomposition machine, comprising:

a support frame;

a plurality of indicia storage disc members mounted in superposed relationship about a common axis, each said disc having at least one data set in a circular track path;

means for rotating at least one of said disc members at any one time;

a read head mounted on said support frame, said read head having a fixed residence in space;

means for effecting relative separating between said read head and said disc members to position said read head beyond the diameter of the largest disc and for selecting ones of a plurality of relative positions wherein said head is adjacent a selected data set track path; and means for effecting relative movement between said storage disc members and said read head along the axis thereof to place a selected one of said discs into alignment with said read head;

whereby, said plurality of discs and head may be removed from interface with one another, shifted to align into a substitute position, and repositioned to select various data sets at will.

4. A font storage and optical retrieval system for photocomposition machine, comprising:

a support carriage;

a plurality of character storage discs mounted in spaced relationship on a common rotatable shaft, each disc having at least one character font in a circular track;

means mounting said shaft on said carriage;

means for driving said shaft in rotary movement;

an illuminating and projecting system having means for producing a light beam and for directing said light beam through a path including an offset side loop portion to a focused image plane;

means mounting said carriage so that said carriage may move in a path perpendicular to the axis of said shaft, said path having a first limit which separates the largest disc carried by said shaft from interference with said side loop portion of said projection system, and a second limit position preselected to position a selected one of said at least one circular track of any selected disc into projection relationship with said loop portion, and means to shift said carriage and shaft in the direction of the shaft axis while said carriage is in said first limit position;

whereby, a selected font of a selected disc may be projected by a photocomposing machine by positioning selected discs resident on said shaft and moving said disc into a position which registers a desired font track with said loop portion.

5. A system as defined in claim 4, wherein said illuminating and projecting system has a first member which is fixed in space and will access various portions of any disc according to the depth of perpendicular movement to a said second position, and a second member which follows the frame movement to maintain a fixed relative spacial relationship.

6. A system as defined in claim 4, wherein the carriage is moved in said path perpendicular to the axis of the shaft by a cam driven by a stepper motor under program control of a photocomposer machine.

7. A font storage and optical retrieval system for a photocomposition machine, comprising:

a support frame;

a plurality of indicia storage disc members mounted in superposed relationship about a common axis, each disc having at least one data set in a circular track path;

means for rotating at least one of said disc members at any one time;

a read head mounted on said support frame, said read head having a fixed residence in space;

means for effecting relative movement between said read head and said disc members to position said read head beyond the diameter of the largest disc and for selecting ones of a plurality of relative position wherein said head is adjacent a selected data track path; and means for effecting relative movement between said storage disc members and said read head along the axis thereof to place a selected one of said discs into alignment with said read head;

whereby, said plurality of discs and head may be removed from interference with one another, shifted to align into a substitute position, and repositioned to select various data sets at will.

* * * * *